US006019039A

United States Patent [19]

Knauer et al.

[11] Patent Number: 6,019,039

[45] Date of Patent: Feb. 1, 2000

[54] WEB-FED ROTARY PRINTING PRESS FOR RAPID CHANGE IN PRODUCTION

[75] Inventors: Peter Knauer, Münster/Lech; Josef Singler, Augsburg, both of Germany

[73] Assignee: MAN Roland Druckmaschinen AG, Offenbach am Main, Germany

[21] Appl. No.: 09/034,781

[22] Filed: Mar. 4, 1998

[30] Foreign Application Priority Data

Mar. 4, 1997 [GB] United Kingdom ..... 197 08 728

[51] Int. Cl.[7] ..... B41F 7/02

[52] U.S. Cl. ..... 101/218; 101/247; 101/220

[58] Field of Search ..... 101/216, 248, 101/247, 218, 229, 177–182, 153, 212, 217, 231, 220, 479

[56] References Cited

U.S. PATENT DOCUMENTS

| | | | |
|---|---|---|---|
| 2,855,846 | 10/1958 | Harless et al. | 101/218 |
| 4,183,297 | 1/1980 | Skiera | 101/218 |
| 4,823,693 | 4/1989 | Kobler | 101/218 |

FOREIGN PATENT DOCUMENTS

| | | |
|---|---|---|
| 0 225 509 | 11/1986 | European Pat. Off. . |
| 0 644 048 A2 | 12/1994 | European Pat. Off. . |
| 0 644 048 A2 | 3/1995 | European Pat. Off. . |
| 27 18 856 | 3/1978 | Germany . |
| 3716188 A1 | 12/1987 | Germany . |
| 4337554 A1 | 6/1994 | Germany . |
| 42 15 969 C2 | 10/1994 | Germany . |
| 41 40 413 C2 | 3/1995 | Germany . |
| 4408025 A1 | 9/1995 | Germany . |
| 44 35 429 A1 | 4/1996 | Germany . |
| 4435429 A1 | 4/1996 | Germany . |
| 549 471 | 5/1974 | Switzerland . |

*Primary Examiner*—Christopher A. Bennett
*Attorney, Agent, or Firm*—Cohen, Pontani, Lieberman & Pavane

[57] ABSTRACT

The invention relates to a web-fed rotary printing press having a plurality of double printing units in which each of the printing units of the double printing units work together in the blanket—blanket method and each has its own drive. Transfer cylinders of each printing unit are driven independently. To permit a rapid change in production, both upon recto and verso printing, the transfer cylinders of the disconnectable double printing units are separable by eccentric bushings or swingable levers such that a web which passes through the printing press is conducted between them without being printed.

8 Claims, 7 Drawing Sheets

FIG. 5
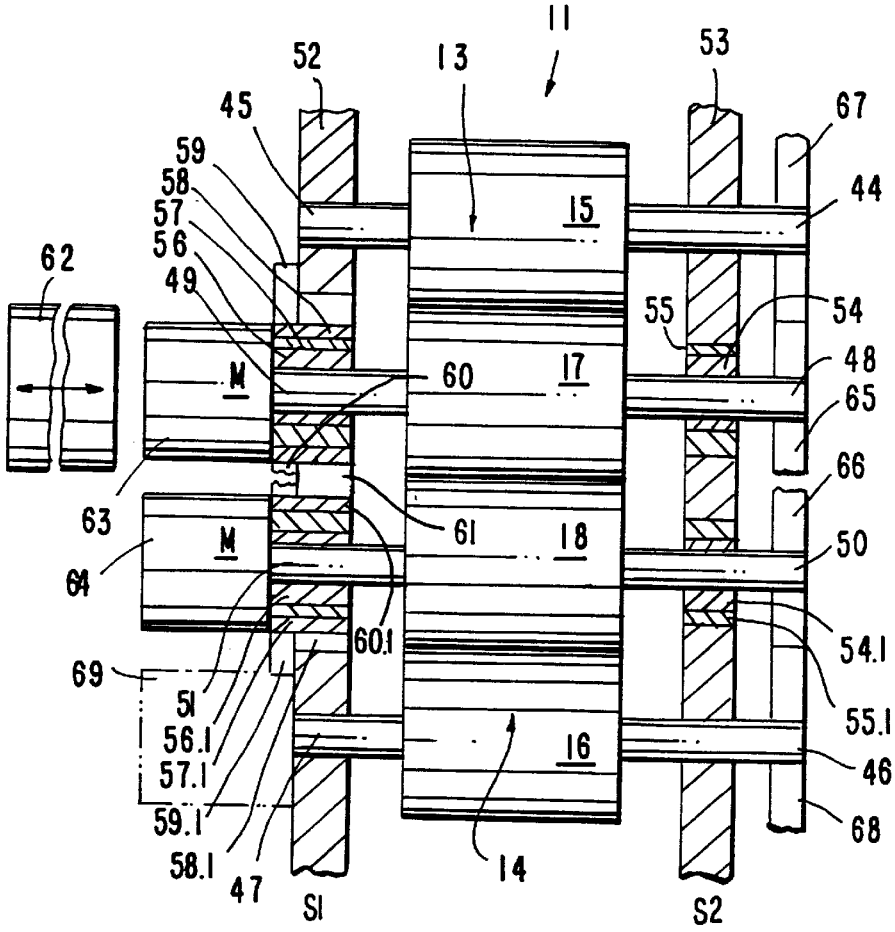
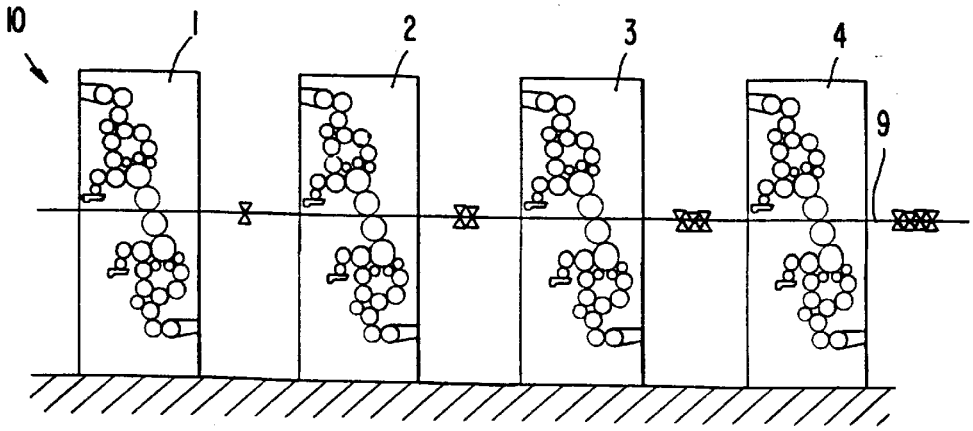
FIG. 9
(PRIOR ART)

WEB-FED ROTARY PRINTING PRESS FOR RAPID CHANGE IN PRODUCTION

BACKGROUND OF THE INVENTION

1. Field of the Invention

The present invention relates to a web-fed rotary printing press capable of rapid production changes having several double printing units. Each individual printing unit of the double printing unit has a form cylinder and a transfer cylinder. The transfer cylinders of the individual printing units are adjustable with respect to each other for printing both sides of a web that is fed through the double printing unit by the blanket—blanket method.

2. Description of the Related Art

Referring to FIG. 9, a known prior art printing press 10 is shown for printing on both sides of a web 9. In this prior art printing press 10, four double printing units 1, 2, 3, and 4 are used to print four colors on each side of the web 9, which is designated as the printing of 4+4 colors. To change the production in this printing press, each of the double printing units 1 through 4 must be stopped. Printing plates in each printing unit are changed for the new production while the entire printing press is stationary. If plate-change aids are not installed in the printing units, the web 9 must also be cut. Changing production requires completely stopping the printing press which results in a corresponding loss of time. Initial spoilage during a restart of the printing press is unavoidable. Although not shown, it is obvious that each of the individual printing units of the double printing units 1 through 4 may include its own drive for rotating its cylinders.

A prior art European reference, EP 0644048 A2, discloses a printing press in which a first printing unit containing a form cylinder and a transfer cylinder cooperates alternately with a similar second or third printing unit in the blanket—blanket method. Each of the printing units has its own drive motor. A change in production can be effected without interrupting the travel of the web, but only one printed image on one web side can be changed at one time.

Another prior art reference, Swiss Patent 549 471, discloses a web-fed rotary printing press with double printing units arranged alongside of each other which, operating by the blanket—blanket method, prints a web which is passed between the transfer cylinders. For changing production, individual printing units are selectively connectable and disconnectable. In the disconnected position, the transfer cylinders of the double printing units are separated by a distance allowing the web to pass through the double printing unit without touching the transfer cylinders. The transfer cylinders are mounted in levers by which they can be swung around a corresponding form cylinders to disconnected the double printing unit. The swinging is effected against spring force by toggle levers acting on the journals of the transfer cylinders.

Similar prior art double printing units which can be selectively operated are shown in German reference DE 44 35 429 A1. In this reference, double printing units are arranged one above the other and work together with a roll changer of adjustable width and with a displaceable folding apparatus. In this reference, the transfer rollers of each double printing unit are selectively separable for changing print productions.

SUMMARY OF THE INVENTION

The object of the invention is to provide a web-fed rotary printing press which allows rapid production changes.

This object is achieved by a web-fed rotary printing press for high-speed production changes, comprising a double printing unit having a first and second printing unit sharing a pair of sidewalls, said first printing unit having a first transfer cylinder and a first form cylinder and said second printing unit having a second transfer cylinder and a second form cylinder, a first drive drivably connected to said first form cylinder and said first transfer cylinder and a second drive drivably connected to said second form cylinder and said second transfer cylinder, and means for moving at least one of said first transfer cylinder and said second transfer cylinder between a connected position, whereat the first transfer cylinder and the second transfer cylinder are positioned for printing both sides of a web which passes therebetween using the blanket—blanket printing method, and a disconnected position, whereat the web passes between said first and second transfer cylinders without being printed, said disconnected position allowing a production change on both sides of said web.

The invention enables the simultaneous transfer to a different printed image on both sides of the web for a change in production. The change may furthermore be carried out during the travel of the web in printing operation. That is, the plate change may be performed on the fly. Due to the separate drives of each of the printing units of a double printing unit and the lack of tooth engagement of their transfer cylinders, the transfer cylinders of each double printing unit may be separated by such a distance that a web passes uninfluenced between them for continuous printing in other double printing units of the printing press of the invention. The requirement for cutting and newly inserting the web during a production change is thereby eliminated. A resulting change in production is thus time-saving and spoilage-saving. Depending on the degree of sophistication of the printing press having the disconnectable double printing units of the present invention, it is possible for a 4-color production on both sides of a web to be changeable on the fly. That is, the production change may be accomplished during continuous feeding of the web through the printing press.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The invention will be explained in further detail below with reference to several embodiments which are shown diagrammatically in the drawings.

FIG. 5 shows a portion of a vertical double printing unit in front view (view V—V of FIG. 1*b*);

FIG. 9 shows a prior art printing press and printing unit configuration.

DETAILED DESCRIPTION OF THE PRESENTLY PREFERRED EMBODIMENTS

Figure 1A:
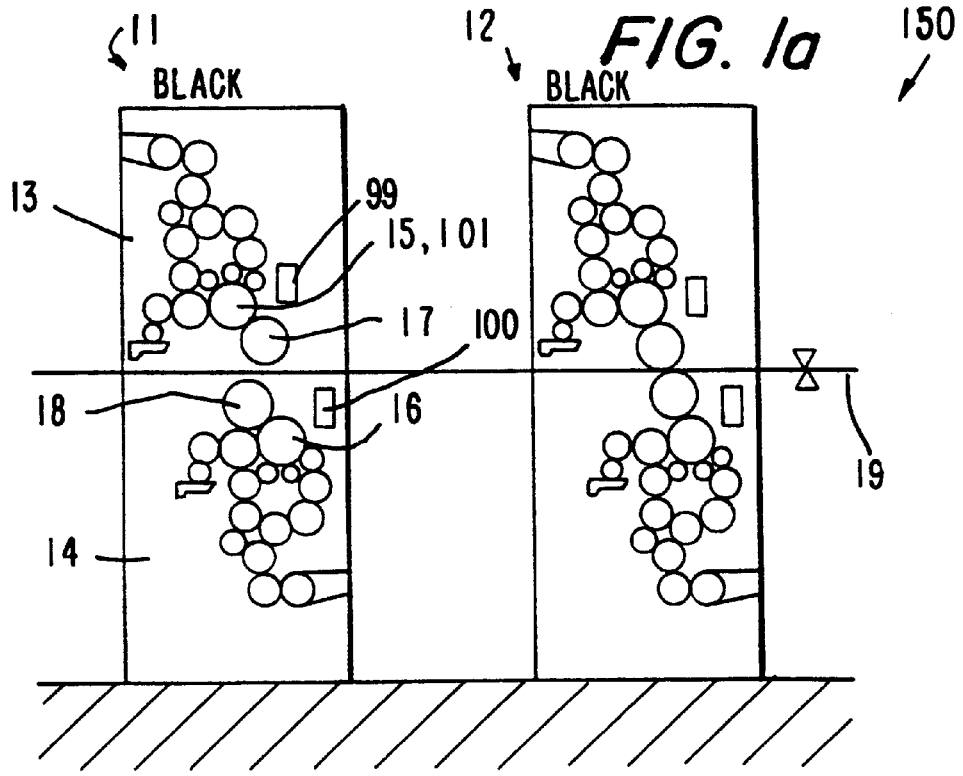
FIG. 1*a* shows two double printing units of an embodiment of a printing press according to the invention.

Referring initially to FIG. 1*a*, two double printing units 11, 12 are shown in a first embodiment of a printing press 150. Further attachments of the printing press 150, such as unrolling and folding apparatus are not shown here, nor in the following embodiments. Each double printing unit 11, 12 contains two printing units 13, 14, each of which has a form cylinder 15, 16 and a transfer cylinder 17, 18. The printing units 13, 14 are arranged above one another and form an I-printing unit for the double-sided printing of a horizontally conducted web 19. The double printing units 11 and 12 (I-printing units) are identical to each other. Therefore, in this and the following embodiments, the reference characters for the individual parts are shown only on the double printing unit 11 for simplification of the drawings. In special cases where there are differences between corresponding parts, different suffixes (e.g., 0.1 and 0.2) are added to the reference characters to differentiate the parts.

In FIG. 1*a*, the double printing unit 11 is shown in a disconnected state. That is, the transfer cylinders 17, 18 are positioned so that they do not contact the web 19 which is conducted through double printing unit 11. The web 19 passes to the other double printing unit 12 where the web is printed in a 1+1 format, or one color on each side. The form cylinders 15, 16 and the transfer cylinders 17, 18 are stationary in the disconnected state. A distance between the two transfer cylinders 17, 18 of about 20 mm is sufficient in the disconnected state such that the web passes between the two transfer cylinders 17, 18 uninfluenced. If a line connecting the centers of transfer cylinders 17 and 18 is slightly inclined with respect to a line normal to the web 19, which is possible with only a small gap of the tensioning channel for the rubber blanket or upon the use of a rubber-blanket sleeve, the sufficient distance is reduced somewhat to, for instance, 10 mm. When double printing unit 11 is in the disconnected state, double printing unit 11 is available for a change in production both on the form cylinder 15 and on the form cylinder 16 while the printing press 150 continues printing web 19 with the double printing unit 12.

Figure 1B:
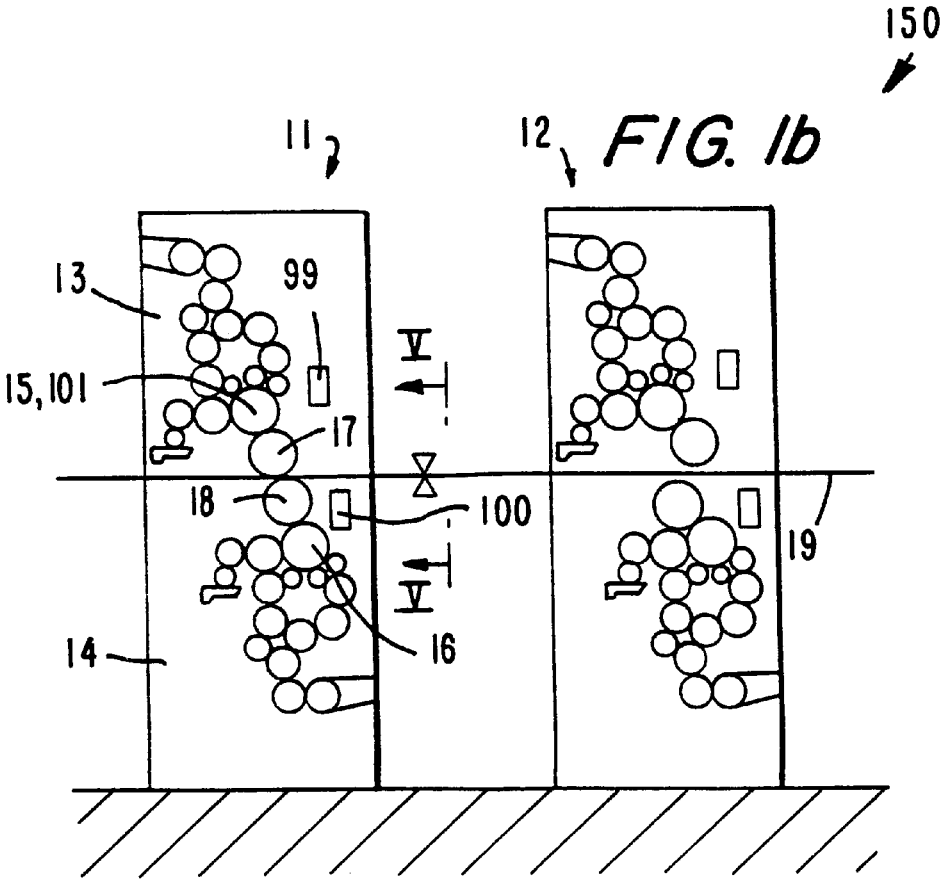
FIG. 1*b* shows the printing unit configuration of FIG. 1*a* after a change in production.

In FIG. 1*b*, the double printing unit 11 is in the connected state and the double printing unit 12 is now in the disconnected state. This switching is possible at the full speed of web 19. A change in production is therefore carried out without stopping or even slowing down the web 19. With the double printing unit 12 disconnected, the web 19 is printed in the 1+1 format by the double printing unit 11 and is then passed between the transfer cylinders 17 and 18 of the double printing unit 12 which are sufficiently separated. Now a change of plate for a production change may be effected at the double printing unit 12 both on the upper form cylinder 15 and on the lower form cylinder 16. A plate-change device 99, 100 is advantageously associated for this purpose with each printing unit 13, 14. The plate-changing devices 99, 100 are well known to the person skilled in the art and they will not be discussed in further detail. The plate-changing devices 99, 100 may, for instance, be completely automatic plate-change devices such as shown in DE 41 40 413 C2 or semiautomatic plate-change devices such as shown in DE 42 15 969 C2. Such plate-change devices may also be used in the printing units which are described below, the form cylinders of which are covered by a finite printing plate.

A printing plate 101 is indicated symbolically on the form cylinder 15 in FIGS. 1*a* and 1*b*. After the plate change or else without a plate change being effected, the double printing unit 12 may be reconnected for further printing. With the plate-change devices 99, 100, a very rapid plate changing is possible so that the double printing unit 12 may be made available quickly for another production change as desired. The double printing units 11, 12 act as two-sided single printing units. Their use in the configuration indicated in FIGS. 1*a* and 1*b*, is suited for book printing, in which both double printing units 11, 12 are intended for printing the color black.

Figure 2A:
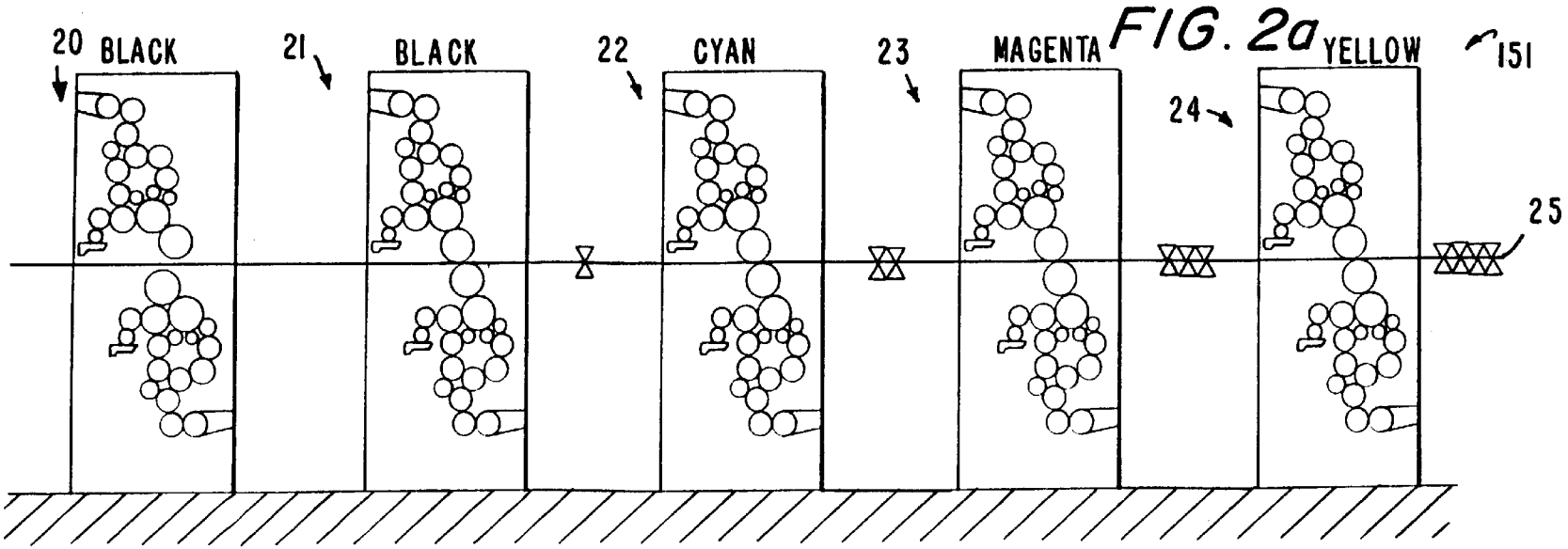
FIG. 2*a* shows five double printing units of another embodiment of a printing press according to the invention.
Figure 2B:
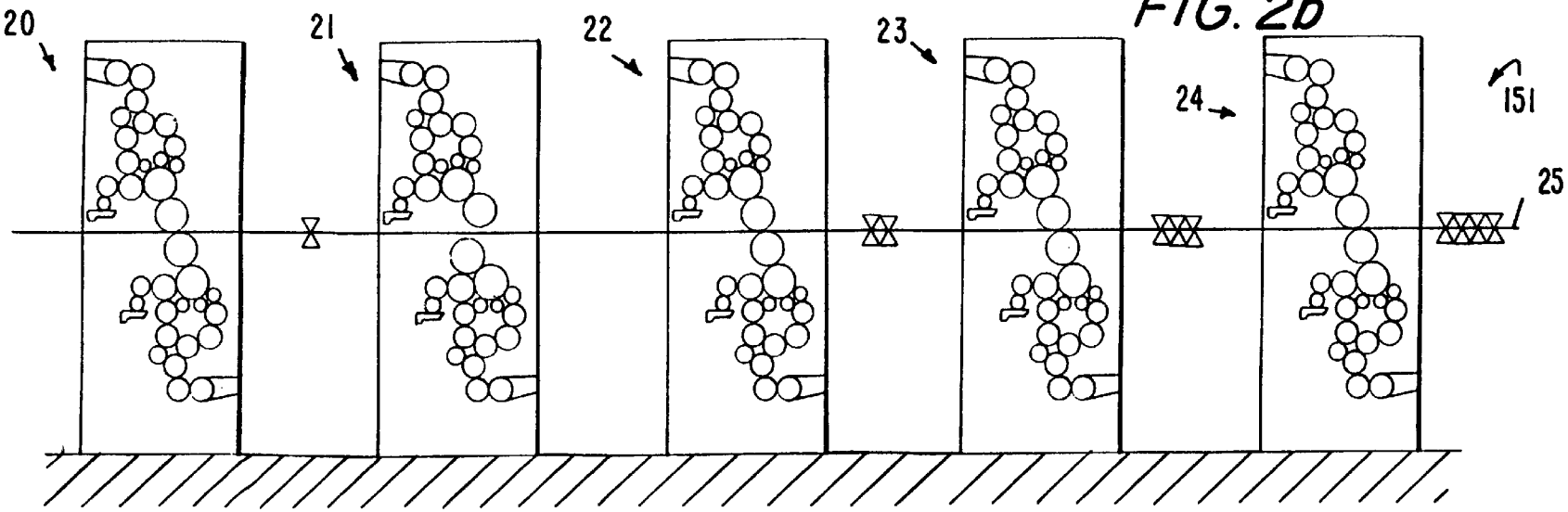
FIG. 2*b* shows the printing unit configuration of FIG. 2*a* after a change in production.

In FIGS. 2*a* and 2*b*, another printing press 151 contains five disconnectable double printing units 20–24. FIG. 2*a* shows the double printing unit 20 in a disconnected state while the other double printing units 21 to 24 print the web 25 in a 4+4 configuration. The double printing units 21, 22, 23, and 24 preferably print in black, cyan, magenta, and yellow, respectively. During the 4+4 printing, the printing plates for the next production are installed in the stationary double printing unit 20.

In FIG. 2*b*, the printing press 151 is switched, i.e. the double printing unit 21 is disconnected and the double printing unit 20 which prints the color black is connected. The web 25 which is printed in a 1+1 format by the double printing unit 20 is then passed through the disconnected double printing unit 21 and printed in succession with the colors cyan, magenta and yellow by the double printing units 22, 23 and 24. Thereby, the web 25 is printed in 4+4 format again. The configuration of printing press 151 is advantageous for advertising and catalog printing, the double printing units 20 and 21 operating as two-sided single printing units and used, for instance, for business, price or text printing. Changing in production in double printing units 20 and 21 is thus possible on the fly during continuous printing.

Figure 3A:
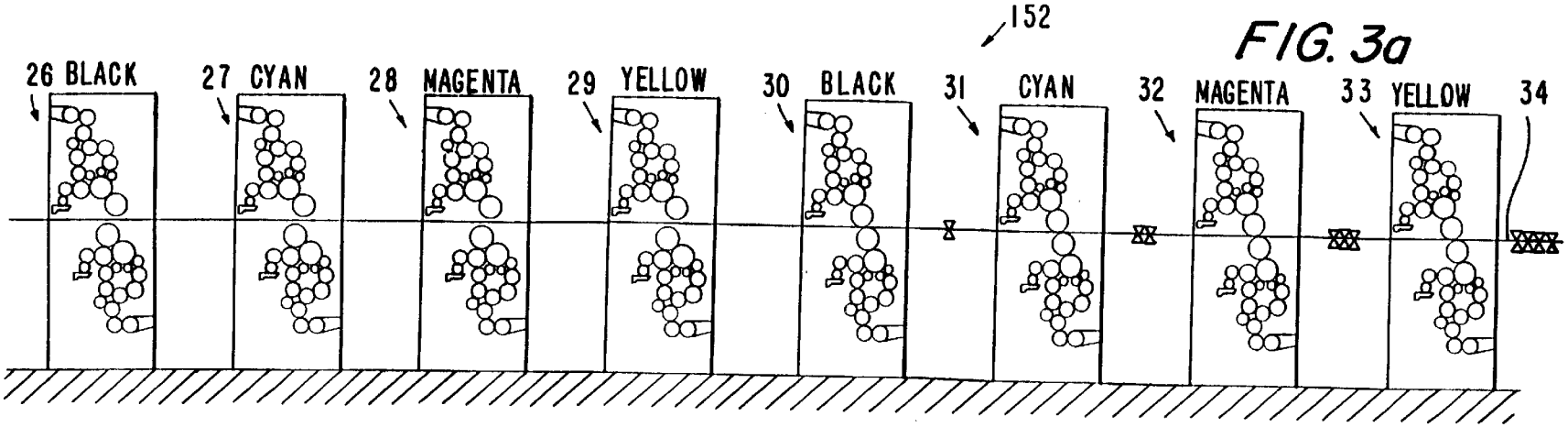
FIG. 3*a* shows eight double printing units of yet another embodiment of a printing press according to the invention.
Figure 3B:
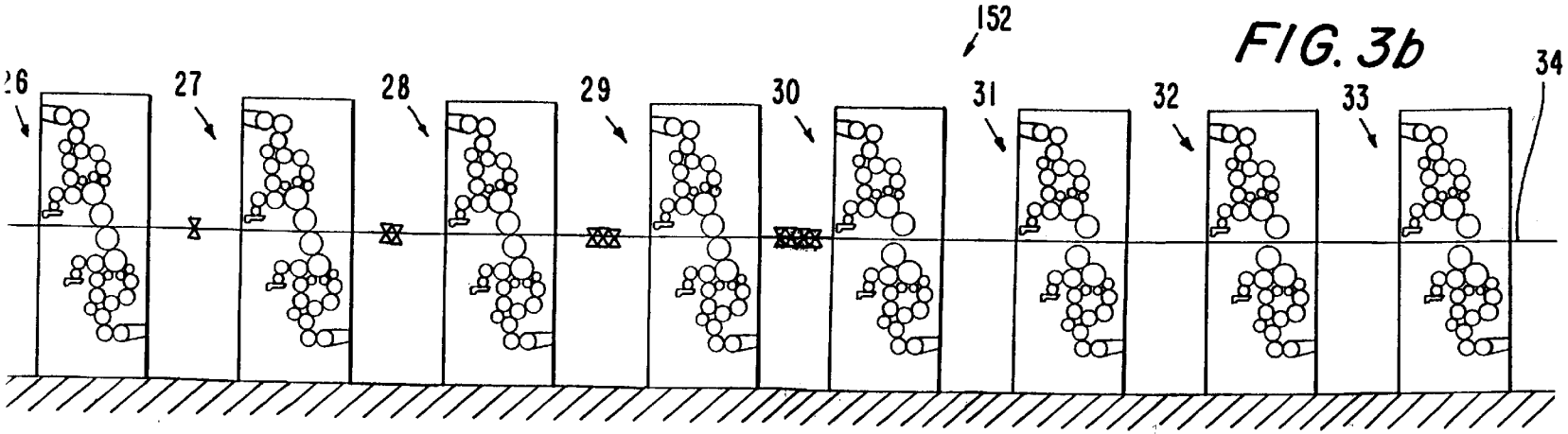
FIG. 3*b* shows the printing unit configuration of FIG. 3*a* after a change in production.

FIGS. 3*a* and 3*b* show eight disconnectable double printing units 26 to 33 of a printing press 152. In FIG. 3*a*, the double printing units 26 to 29 are disconnected. A web 34 is first passed through the disconnected double printing units 26 to 29. The connected double printing units 30 to 33 then print the web 34 on both sides with the sequence of colors black, cyan, magenta and yellow. During this time, a production change for the disconnected double printing units 26 to 29 may be performed.

When a change in production is required, the double printing units 26 to 29 with print plates for a new production are placed in the connected state and the double printing unit 30 to 33 are placed in the disconnected state. The now connected double printing units 26 to 29 now print the colors black, cyan, magenta and yellow on both sides of the web 34, whereupon the web passes through the disconnected double printing units 30 to 33. The now disconnected printing units 30 to 33 are now available for another change in printing production. The printing units 26 to 33 therefore represent change printing units with which a change may be performed "on the fly" from one two-sided 4-color production to another. Without using the change in production capability of this configuration, two separate webs may be printed in a 4+4 format.

Figure 4A:
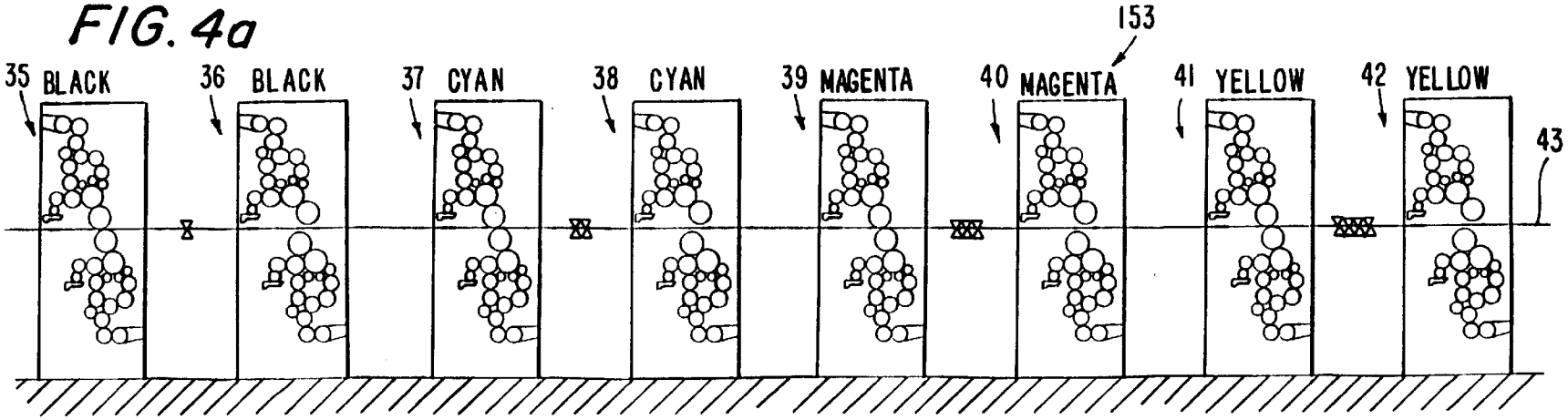
FIG. 4*a* shows another embodiment of the printing press of FIG. 3*a;*
Figure 4B:
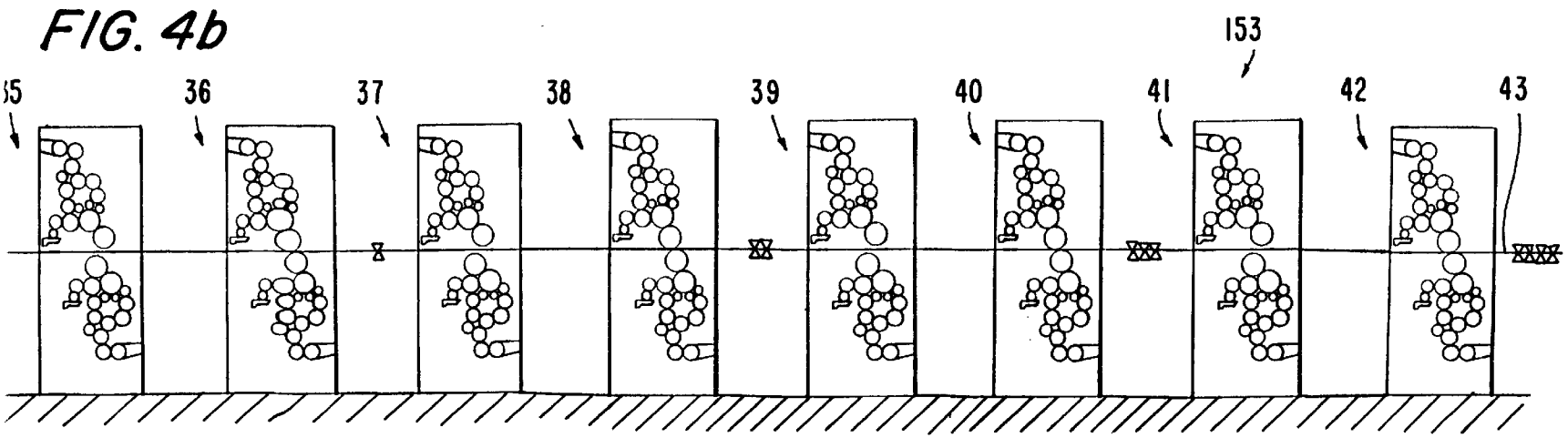
FIG. 4*b* shows the printing unit configuration of FIG. 4*a* after a change in production.

FIGS. 4*a* and 4*b* show a further embodiment of a printing press 153. It contains eight disconnectable double printing units 35 to 42 for the 4+4 printing of a web 43. In accordance with FIG. 4*a*, the double printing units 35, 37, 39 and 41 are connected and print the web 43 in all colors on both sides with the color sequence black, cyan, magenta and yellow. The connected double printing units 35, 37, 39, 41 are alternately followed in each case in the direction of travel of the web by disconnected double printing units 36, 38, 40 and 42 through which the web 43 is passed without contact. The disconnected printing units 36, 38, 40, 42 are available for a change in production on both the upper and the lower printing units.

When a change in production is required, the double printing units 35, 37, 39, 41 are placed in the disconnected state and the double printing units 36, 38, 40, 42 are placed in the connected state. This operating position is shown in FIG. 4*b*. A new production is now printed on the web 43 by the connected double printing units 36, 38, 40, 42 in four colors on both sides in the color sequence black, cyan, magenta and yellow. The disconnected double printing units 35, 37, 39, 41 are available for changing to yet another production when desired.

Drive variants for the double printing units as well as path adjustment possibilities for their transfer cylinders will be discussed below. FIG. 5 shows the double printing unit 11 in front view (V—V according to FIG. 1*b*). Journals 44–51 of the form cylinders 15, 16 and transfer cylinders 17, 18, respectively, are mounted in printing-unit side walls 52, 53. Journal 48 of the transfer cylinder 17 is received by two eccentric bushings 54 and 55 in side wall 53. Bushing 54 receives the journal 48 and bushing 55 receives the bushing 54 to form a double eccentric mounting. Similarly, journal 49 is received by eccentric bushing 56 which is received by eccentric bushing 57 for a double eccentric mount. An approximately linear displacement of the transfer cylinder 17 is obtained by simultaneous rotation of each pair of eccentric bushings 54, 55 and 56, 57 respectively. The adjustment in position of the transfer cylinder 17 should be effected far away from the transfer cylinder 18 and less far from the form cylinder 15. For this purpose, the direction of adjustment in position is approximately perpendicular to the line connecting the centers of transfer cylinder 17 and form cylinder 15. (This corresponds for instance approximately to the initial direction of swing of the transfer cylinder 18.1 in FIG. 6 which is described below.) The journals 50, 51 of the transfer cylinder 18 are mounted in eccentric bushings 54.1 to 57.1 similarly to the mounting of journals 48 and 49. Transfer cylinder 18 has a similar possibility of adjustment of path with respect to the transfer cylinder 17 and the form cylinder 16.

The eccentric bushings 56, 57 are mounted indirectly in the operating-side (S1) of printing-unit side wall 52 and are centered within a sleeve 58. Sleeve 58 is clamped in slides 59, 60. Slides 59, 60 are movable along the printing-unit side wall 52. In a manner analogous to this, the eccentric bushings 56.1, 57.1 of the transfer cylinder 18 are arranged in a sleeve 58.1 which can be clamped by slides 59.1, 60.1. Upon the separating of the corresponding slides 59, 60 or 59.1, 60.1, an opening 61 is exposed in the printing-unit side wall through which rubber-blanket sleeves 62 of the transfer cylinders 17, 18 may be changed. A rubber-blanket sleeve 62 is shown in position of readiness for the transfer cylinder 17. For the change in sleeves, the transfer cylinder 17 is held suspended by means acting on the journal 48 which are not shown, but with which the person skilled in the art is acquainted. Similar means may be provided if the form cylinders 15, 16 are to operate with sleeve-shaped printing forms. It is also possible to provide the transfer cylinders 17, 18 with finite printing blankets, in which connection the sleeves 58, 58.1 and slides 59, 60, 59.1, 60.1 are not present.

Each printing unit 13, 14 has its own drive by which it is driven in continuous printing. Before connecting each individual printing unit to the web, the cylinders are accelerated to the speed of the web. In particular, the transfer cylinder 17 is driven by an electric motor 63, and the transfer cylinder 18 is driven by an electric motor 64. The stators of the electric motors 63, 64 follow the movement of displacement of the transfer cylinders 17, 18 and are fastened, for instance, on the corresponding one of eccentric bushings 56, 56.1. Each of the journals 48, 50 of the transfer cylinders 17, 18 bears a spur gear 65, 66 which engages another spur gear 67, 68 on the journals 44, 46 of the form cylinders 15, 16. The spur gears 65 and 66 are so disposed with negative profiles with respect to each other so that they do not engage with each other even if they are accidentally moved toward each other. The other spur gears 67, 68, on the other hand, have the required corresponding positive profile displacement for drive connection with the spur gears 65, 66. The motors 63, 64 may optionally be associated with the form cylinders 15, 16. Alternatively, all form and transfer cylinders 15 to 18 may comprise its own drive motor, in which event the requirement for spur gears 65 to 68 is eliminated. An electric motor 69 is shown in a dash-dot line to indicate this optional embodiment. A similar motor would also be connected to the form cylinder 15. The motors 63, 64, 69 may also be provided on the so-called drive side S2. With a suitable design of the eccentric bushings 54 to 57 and 54.1 to 57.1, the displacement of only one transfer cylinder 17, 18 may be used to sufficiently space apart the transfer cylinders 17, 18.

Figure 6:
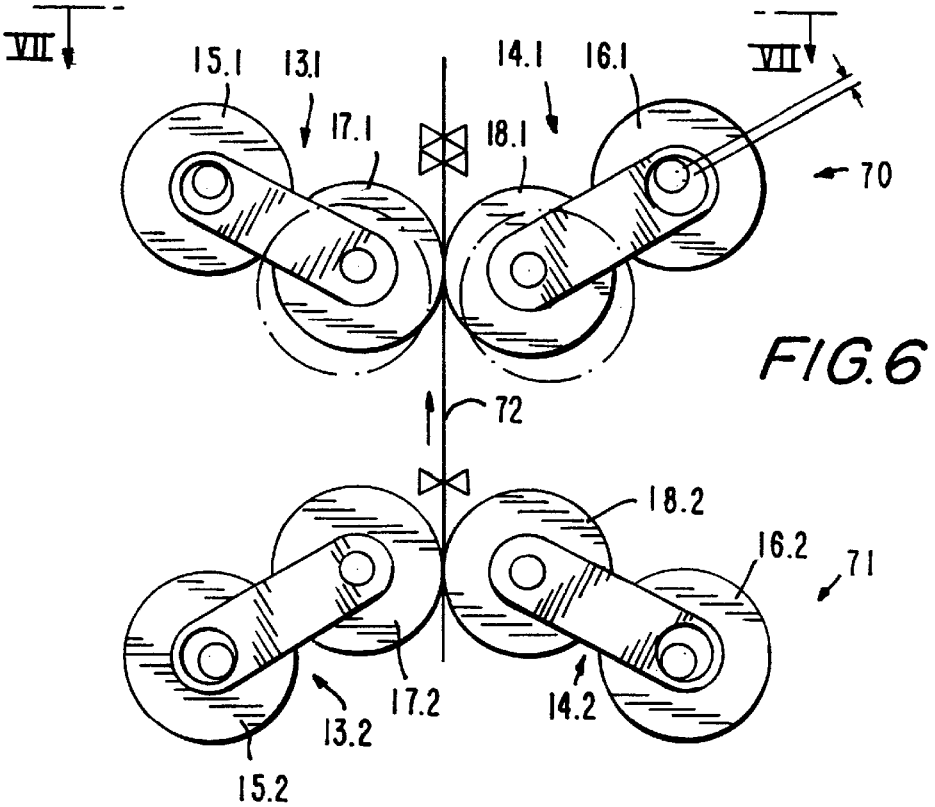
FIG. 6 shows a printing unit with horizontal double printing units.

FIG. 6 shows two double printing units 70, 71 arranged horizontally. They form a so-called H-printing unit, which is used in newspaper printing. Each printing unit 13.1, 14.1, 13.2, 14.2 contains a form cylinder 15.1, 16.1, 15.2, 16.2, and a transfer cylinder 17.1, 18.1, 17.2, 18.2. The transfer cylinders 17.1, 18.1, and 17.2, 18.2 of each double printing unit 70, 71 can be adjustably positioned with respect to each other such that a web 72 which is passed between them is printed on both sides.

The transfer cylinders 17.1, 18.1, and 17.2, 18.2 of the double printing units 70, 71, on the other hand, may also be separated for selectively disconnecting the double printing units 70 and 71. In the disconnected state, the web 72 passes through the disconnected one of the double printing units 70, 71 and possibly other double printing units in printing operation. In the embodiment shown in FIG. 6, the web 72 is printed in a 2+2. However, the transfer cylinders 17.1, 18.1 may be swung into the position shown in dot-dash line. In that case, the web 72 is printed in one color on both sides by the double printing unit 71 and passes through the disconnected transfer cylinders 17.1, 18.1 to a further printing unit, where it can be printed with further colors.

On the disconnected double printing unit 70, the printing forms at form cylinders 15.1, 16.1 may be changed for a subsequent change in production. When the change in production occurs, the speed of the drives of the printing units 13.1, 14.1 is increased in speed and set against each other, in which connection they now print the web 72 which is traveling at the printing speed. Thereupon, if both double printing units 70, 71 are to operate alternately, the transfer cylinders 17.2, 18.2 swing away. Now, a change of plates may be effected on the form cylinders 15.2, 16.2 for a subsequent change in production with the web 72 traveling at normal printing speeds. The alternative additional operation of double printing units instead of alternate operation with other double printing units is furthermore possible also in the embodiments already described above. With suitable design of levers 77 to 80 (see FIG. 7), the displacement of only one transfer cylinder 17.1, 18.1 or 17.2, 18.2 is also sufficient for their separation for disconnection.

Figure 7:
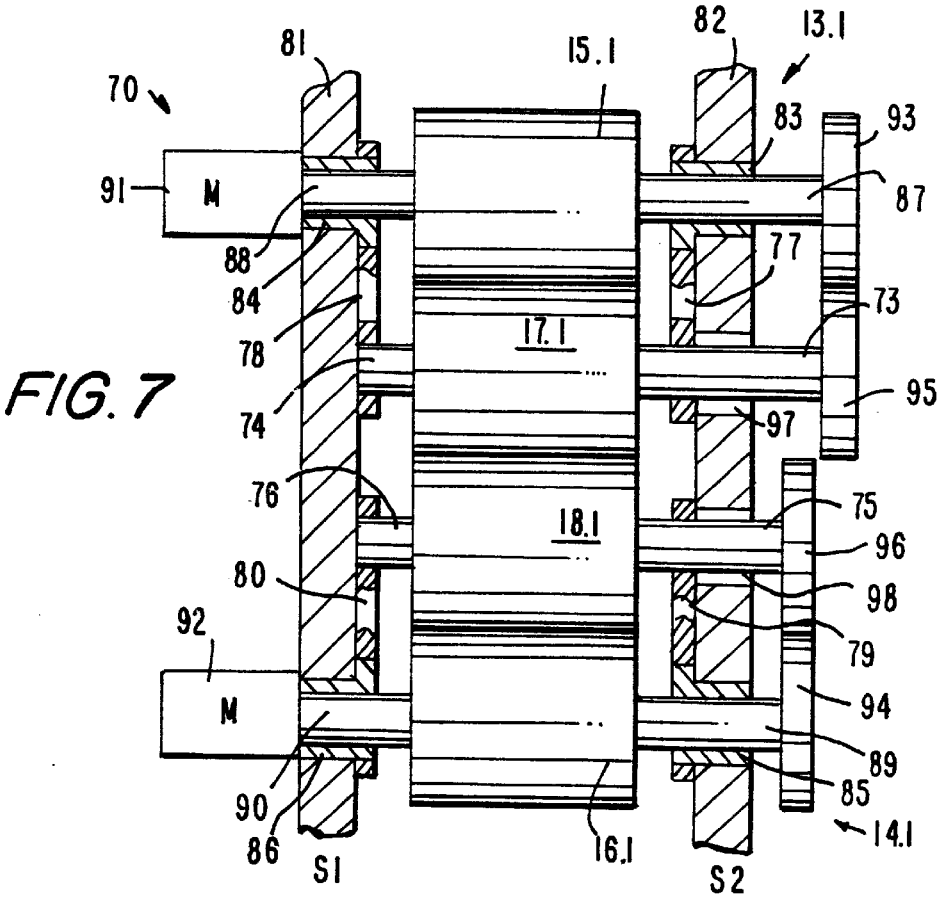
FIG. 7 shows the view VII—VII of FIG. 6.

For the double printing units 70, 71 arranged one on top of the other (newspaper printing) it is sufficient, with the double printing unit 70 disconnected, to separate the transfer cylinders 17.1, 18.1 by a distance of about 10 mm. For the turning off of the transfer cylinders 17.1, 18.1 there are contemplated as further variant embodiments in accordance with FIG. 5 swingable levers with which large displacement paths may also be obtained. Referring now also to FIG. 7, the journals 73 to 76 of the transfer cylinders 17.1, 18.1 are mounted in levers 77 to 80 which are arranged swingable on the machine side walls 81, 82. The levers 77 to 80 are mounted eccentrically with an eccentricity e to the form cylinders 15.1, 16.1. Upon the necessary disconnect movements of the transfer cylinders 17.1, 18.1 with respect to each other, sufficient of the form cylinders 15.1, 16.1 is also obtained due to the eccentricity (FIG. 6). Preferably, the swingable mounting of the levers 77 to 80 is effected on eccentric flanges of bearing sleeves 83 to 86 which receive the journals 87 to 90 of the form cylinders 15.1, 16.1.

Each of the printing units 13.1 and 14.1 has its own drive. The form cylinder 15.1 is driven by an electric motor 91, and the form cylinder 16.1 is driven by an electric motor 92 (FIG. 7). The drives are not shown in FIG. 6. On the journals 87, 89 of the form cylinders 15.1, 16.1 there is arranged in each case a spur gear 93, 94 which engages a corresponding spur gear 95, 96 on the journals 73, 75 of the corresponding transfer cylinder 17.1, 18.1. The spur gears 93, 95 and 94, 96 are arranged in two planes, whereby displacements in profile (referred to in accordance with FIG. 5) are unnecessary. To assure the swingability of the transfer cylinders 17.1, 18.1, their journals 73, 75 are guided in recesses 97, 98 by the printing-unit side wall 82. These recesses 97, 98 may be eliminated if the spur gears 93 to 96 are arranged alongside the levers 77 to 80 between the printing-unit side walls 81, 82. The other drive variants mentioned with regard to FIG. 5 are also possible in the embodiment of FIG. 7. Furthermore, in all embodiments, the electric motors 63, 64, 69, 91, 92 may be placed on the drive side S2 and the spur gears 65 to 68, 93 to 96 on the operator's side S1. The double printing unit 71 is similar in construction to the double printing unit 70; it is merely arranged with mirror symmetry. Therefore, further description is unnecessary.

Figure 8:
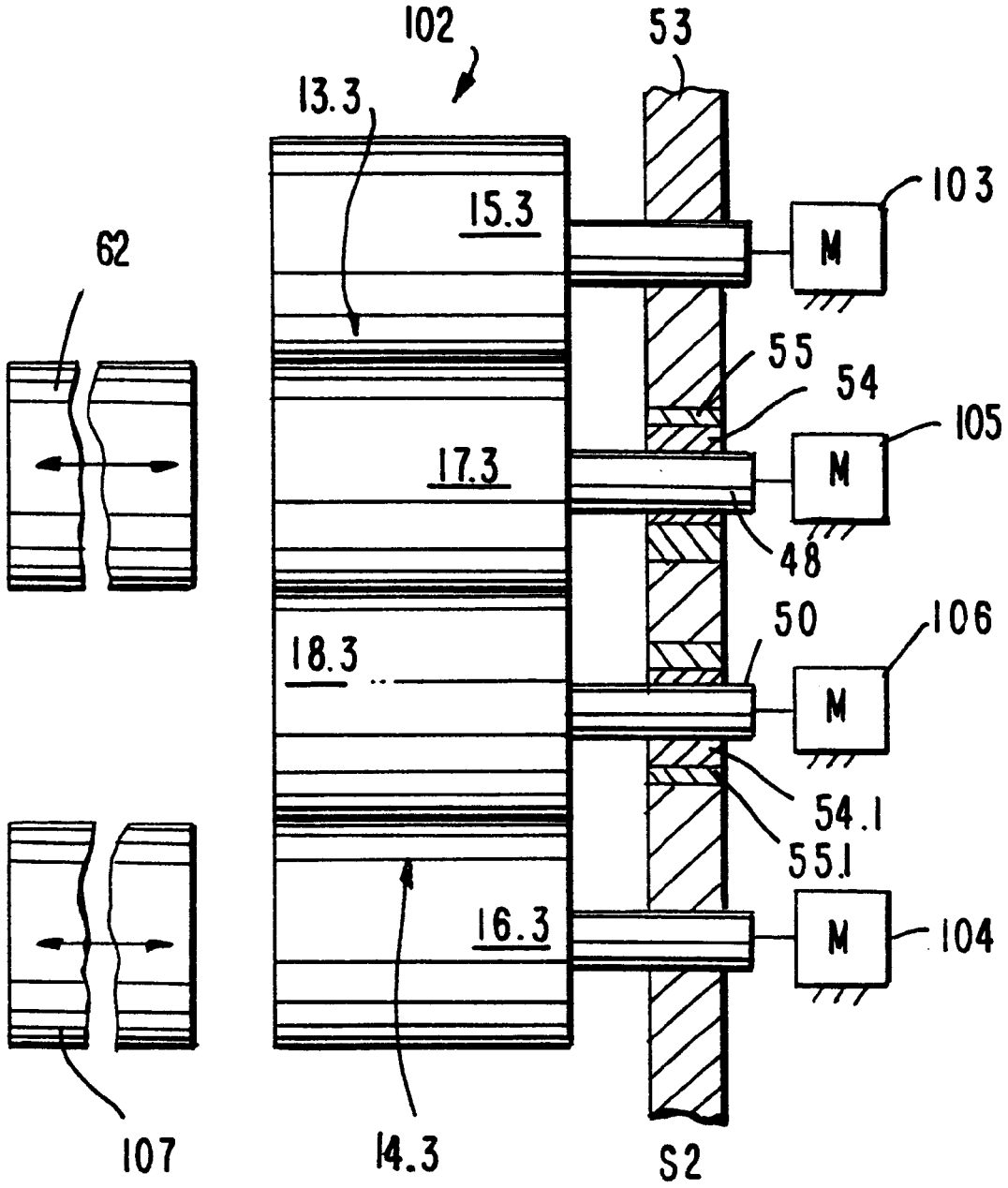
FIG. 8 shows a double printing unit according to another embodiment of the invention.

FIG. 8 shows a front view of a double printing unit 102 with printing units 13.3 and 14.3, the corresponding form cylinders 15.3, 16.3 and 17.3, 18.3 of which are rotatably mounted in a printing-unit side wall 53. Each of the form and transfer cylinders 15.3 to 18.3 is driven by a separate electric motor 103 to 108, respectively. Each of the journals 48, 50 of transfer cylinders 17.3, 18.3 is mounted in two eccentric bushings 54, 55 and 54.1, 55.1 in the printing-unit side wall 53. Switching to the disconnected state is effected in a manner similar to that described with reference to FIG. 5, so that repetitive explanations are unnecessary. The transfer cylinders 17.3, 18.3 bear rubber blanket sleeves 62, and the form cylinders 15.3, 16.3 bear printing form sleeves 107. These sleeves 107, 62 are easily withdrawn from the form and transfer cylinders 15.3 to 18.3 and replaced, since these cylinders 15.3 to 18.3 are freely accessible at one end due to their mounting. A rubber blanket sleeve 62 and a printing form sleeve 107 are shown in FIG. 8 in position of readiness for the change. After the turning-off of the electric motors 103 to 106 and the moving of the transfer cylinders 17.3, 18.3 back into the disconnected position by actuation of the eccentric bushings 54, 55, 54.1, 55.1, the change in sleeves on the form and transfer cylinders 15.2 to 18.3 is possible.

The electric motors 63, 64, 69, 91, 92, 103 to 106 are advantageously adjusted in their angle within the scope of the machine control by a computer motor control. The running-up in speed for the intended connecting of a double printing unit 11, 12, 20 to 24, 26 to 33, 35 to 43, 70, 71, 102 to the required speed can also be controlled by said computer control. The connecting and disconnecting of the corresponding double printing units 11, 12, 20 to 24, 26 to 33, 35 to 43, 70, 71, 102 can be brought about by a production preparation system or by hand.

In addition to the braking, accelerating and driving functions, the motors also have the task of driving the printing mechanisms for the change in plate or washing of the inking and rubber-blanket cloths.

Each of the double printing units 11, 12, 20 to 24, 26 to 33, 35 to 43, 70, 71, and 102 operate in accordance with an indirect printing method, for instance by offset printing or indirect intaglio printing. Ink and/or wetting units are not shown in the drawings for reasons of simplicity.

The invention is not limited by the embodiments described above which are presented as examples only but can be modified in various ways within the scope of protection defined by the appended patent claims.

We claim:

1. A web-fed rotary printing press for high-speed production changes, comprising:

a double printing unit through which a web is fed having first and second printing units mounted on opposing sides of the web, said first printing unit having a first transfer cylinder and a first form cylinder and said second printing unit having a second transfer cylinder and a second form cylinder;

a first drive drivably connected to said first form cylinder and said first transfer cylinder and a second drive drivably connected to said second form cylinder and said second transfer cylinder;

means for moving at least one of said first transfer cylinder and said second transfer cylinder between a connected position, whereat the first transfer cylinder and the second transfer cylinder are positioned for printing both sides of the web which passes therebetween using the blanket—blanket printing method, and a disconnected position, whereat the web passes between said first and second transfer cylinders without being printed, said disconnected position of said first and second transfer cylinders allowing a production change of the first printing unit and the second printing unit while the web passes therebetween; and said first and second transfer cylinders having journals and said means for moving comprising double eccentric bushings for receiving said journals such that rotation of said double eccentric bushings effects a movement of said first and second transfer cylinders between said connected and said disconnected position.

2. The web-fed rotary printing press of claim 1, wherein said first and second transfer cylinders comprises rubber blanket sleeves and said form cylinders comprise printing plates;

said first and second printing units comprise plate exchange devices for changing said printing plates; and said double printing unit comprises a sidewall with an exposable opening through which said rubber blanket sleeves are changeable.

3. The web-fed rotary printing press of claim 1, wherein said first and second transfer cylinders comprise rubber blanket sleeves and said form cylinders comprise printing form sleeves; and said double printing unit comprising a sidewall with an exposable opening providing access for changing said rubber blanket sleeves and said printing form sleeves.

4. The web-fed rotary printing press of claim 1, wherein the transfer cylinders comprise rubber blanket sleeves, the form cylinders comprise printing form sleeves, and one end of each of the transfer cylinders and the form cylinders is rotatably mounted in a side wall of the double printing unit such that the other ends of the form cylinders and transfer cylinders are accessible for changing the rubber blanket sleeves and printing form sleeves.

5. A web-fed rotary printing press for high-speed production changes, comprising:

a double printing unit through which a web is fed having first and second printing units mounted on opposing sides of the web, said first printing unit having a first transfer cylinder and a first form cylinder and said second printing unit having a second transfer cylinder and a second form cylinder; and a first drive drivably connected to said first form cylinder and said first transfer cylinder and a second drive drivably connected to said second form cylinder and said second transfer cylinder;

means for moving at least one of said first transfer cylinder and said second transfer cylinder between a connected position, whereat the first transfer cylinder and the second transfer cylinder are positioned for printing both sides of the web which passes therebetween using the blanket—blanket printing method, and a disconnected position, whereat the web passes between said first and second transfer cylinders without being printed, said disconnected position of said first and second transfer cylinders allowing a production change of the first printing unit and the second printing unit while the web passes therebetween, wherein said first and second transfer cylinders comprise journals and said means for moving comprises eccentrically mounted lever for receiving said journals, wherein rotation of said levers about the eccentric mounting effects a movement of said first and second transfer cylinders between said connected position and said disconnected position.

6. The web-fed rotary printing press of claim 5, wherein said first and second transfer cylinders comprises rubber blanket sleeves and said form cylinders comprise printing plates;

said first and second printing units comprise plate exchange devices; and said double printing unit comprises a sidewall with an exposable opening through which said rubber blanket sleeves are changeable and through which said printing plates are replaceable using the plate exchange devices.

7. The web-fed rotary printing press of claim 5, wherein said first and second transfer cylinders comprise rubber blanket sleeves and said form cylinders comprise printing form sleeves; and said double printing unit comprising a sidewall with an exposable opening providing access for changing said rubber blanket sleeves and said printing form sleeves.

8. The web-fed rotary printing press of claim 5, wherein the transfer cylinders comprise rubber blanket sleeves, the form cylinders comprise printing form sleeves, and one end of each of the transfer cylinders and the form cylinders is rotatably mounted in a side wall of the double printing unit such that the other ends of the form cylinders and transfer cylinders are accessible for changing the rubber blanket sleeves and printing form sleeves.

* * * * *